US008797094B1

(12) United States Patent
Washburn et al.

(10) Patent No.: US 8,797,094 B1
(45) Date of Patent: Aug. 5, 2014

(54) ON-CHIP ZERO-TEMPERATURE COEFFICIENT CURRENT GENERATOR

(71) Applicant: Synaptics Incorporated, Santa Clara, CA (US)

(72) Inventors: Clyde Washburn, Victor, NY (US); Eric Scott Bohannon, Henrietta, NY (US); Brian Mott, Rochester, NY (US)

(73) Assignee: Synaptics Incorporated, Santa Clara, CA (US)

( * ) Notice: Subject to any disclaimer, the term of this patent is extended or adjusted under 35 U.S.C. 154(b) by 0 days.

(21) Appl. No.: 13/790,798

(22) Filed: Mar. 8, 2013

(51) Int. Cl.
*G05F 1/10* (2006.01)

(52) U.S. Cl.
USPC ..... 327/539; 327/513; 323/313

(58) Field of Classification Search
CPC ..... G05F 3/30; G05F 3/245; G05F 3/242; G05F 3/225; G05F 3/222; G05F 1/436; G05F 1/462; G05F 1/567; G05F 1/561; G05F 3/26; G05F 3/267; G05F 3/262; G05G 1/635; H03K 3/011
USPC ..... 327/513, 539; 323/313, 314, 316
See application file for complete search history.

(56) References Cited

U.S. PATENT DOCUMENTS 5,783,936 A * 7/1998 Girard et al. ..... 323/315
6,087,820 A * 7/2000 Houghton et al. ..... 323/315
6,222,470 B1 * 4/2001 Schuelke ..... 341/119
6,297,685 B1 10/2001 Ewen et al.
6,600,304 B2 * 7/2003 Kim ..... 323/315
6,847,254 B2 * 1/2005 Pai ..... 327/572
6,870,418 B1 * 3/2005 Tang et al. ..... 327/513
6,911,861 B2 * 6/2005 Deng ..... 327/513
6,940,338 B2 * 9/2005 Kizaki et al. ..... 327/543
7,233,195 B2 * 6/2007 Oh ..... 327/538
7,372,316 B2 5/2008 Chatterjee et al.
7,411,443 B2 8/2008 Ivanov et al.
7,486,065 B2 * 2/2009 Lin et al. ..... 323/313
7,852,144 B1 12/2010 Zonte et al.
8,217,713 B1 7/2012 Raghavan et al.
8,358,119 B2 * 1/2013 Kim ..... 323/313
8,373,496 B2 * 2/2013 Cusinato ..... 327/513
8,509,008 B2 * 8/2013 Lee ..... 365/189.09
2008/0111565 A1 * 5/2008 Ausserlechner et al. ..... 324/727
2012/0126616 A1 * 5/2012 Hu et al. ..... 307/31

* cited by examiner

*Primary Examiner* — Thomas J Hiltunen
(74) *Attorney, Agent, or Firm* — Patterson & Sheridan, LLP

(57) ABSTRACT

Embodiments of the invention generally provide generating a ZTC current using resistors that may be integrated into an IC, even if these resistors vary with temperature. Specifically, instead of applying a bandgap voltage across a ZTC resistor, the bandgap voltage may be applied to a temperature-dependent resistor to generate a first current that varies (either proportionally or complementary) with temperature. Additionally, a second current may be generated which compensates for the temperature variance of the first current. If the two currents change in the same manner relative to temperature (i.e., the respective slopes of the currents are the same when the underlying circuit elements are exposed to the same temperature variations), the difference between the currents remains constant. Thus, subtracting the two currents, regardless of the current temperature, results in a ZTC current—i.e., a current that is independent of temperature variations.

12 Claims, 10 Drawing Sheets

ON-CHIP ZERO-TEMPERATURE COEFFICIENT CURRENT GENERATOR

BACKGROUND OF THE INVENTION

1. Field of the Invention

Embodiments of the present invention generally relate to generating a zero-temperature coefficient (ZTC) current, and more specifically, to generating a ZTC current using on-chip resistors.

2. Description of the Related Art

Exposing electronic systems to varying temperatures may alter the physical and electrical characteristics of the devices. For example, the resistivity of some types of resistors changes as the temperature of the resistor changes. Thus, the current flowing through the resistor may change as the resistivity changes. For electronic systems that include circuit elements whose electrical properties change with temperature, in some embodiments, the electronic systems may be designed to minimize the impact of temperature changes on the system's function.

SUMMARY OF THE INVENTION

Embodiments described herein generally provide a method for generating a ZTC current. The method includes generating a first temperature dependent current by applying a temperature independent voltage to a first resistor, wherein the first resistor is included within an integrated circuit. The method includes generating, based on a control parameter, a second temperature dependent current where the first and second temperature dependent currents change at a rate that is substantially the same in response to temperature changes in the integrated circuit. The method includes generating the ZTC current by subtracting the first and second temperature dependent currents.

Embodiments described herein may further provide a circuit that generates a ZTC current. The circuit includes a first resistor included within an integrated circuit and a buffer configured to apply a temperature independent voltage to the first resistor to generate a first temperature dependent current. The circuit also includes a compensation current generator configured to generate, based on a control parameter, a second temperature dependent current where the first and second temperature dependent currents change at a rate that is substantially the same in response to temperature changes in the integrated circuit. Moreover, the circuit is configured to generate the ZTC current by subtracting the first and second temperature dependent currents.

Embodiments described herein may further provide an integrated circuit that generates a ZTC current. The integrated circuit includes a first resistor and a buffer configured to apply a temperature independent voltage to the first resistor to generate a first temperature dependent current. The integrated circuit also includes a compensation current generator configured to generate, based on a control parameter, a second temperature dependent current, wherein the first and second temperature dependent currents change at a rate that is substantially the same in response to temperature changes in the integrated circuit. Further, the integrated circuit is configured to generate the ZTC current by subtracting the first and second temperature dependent currents.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
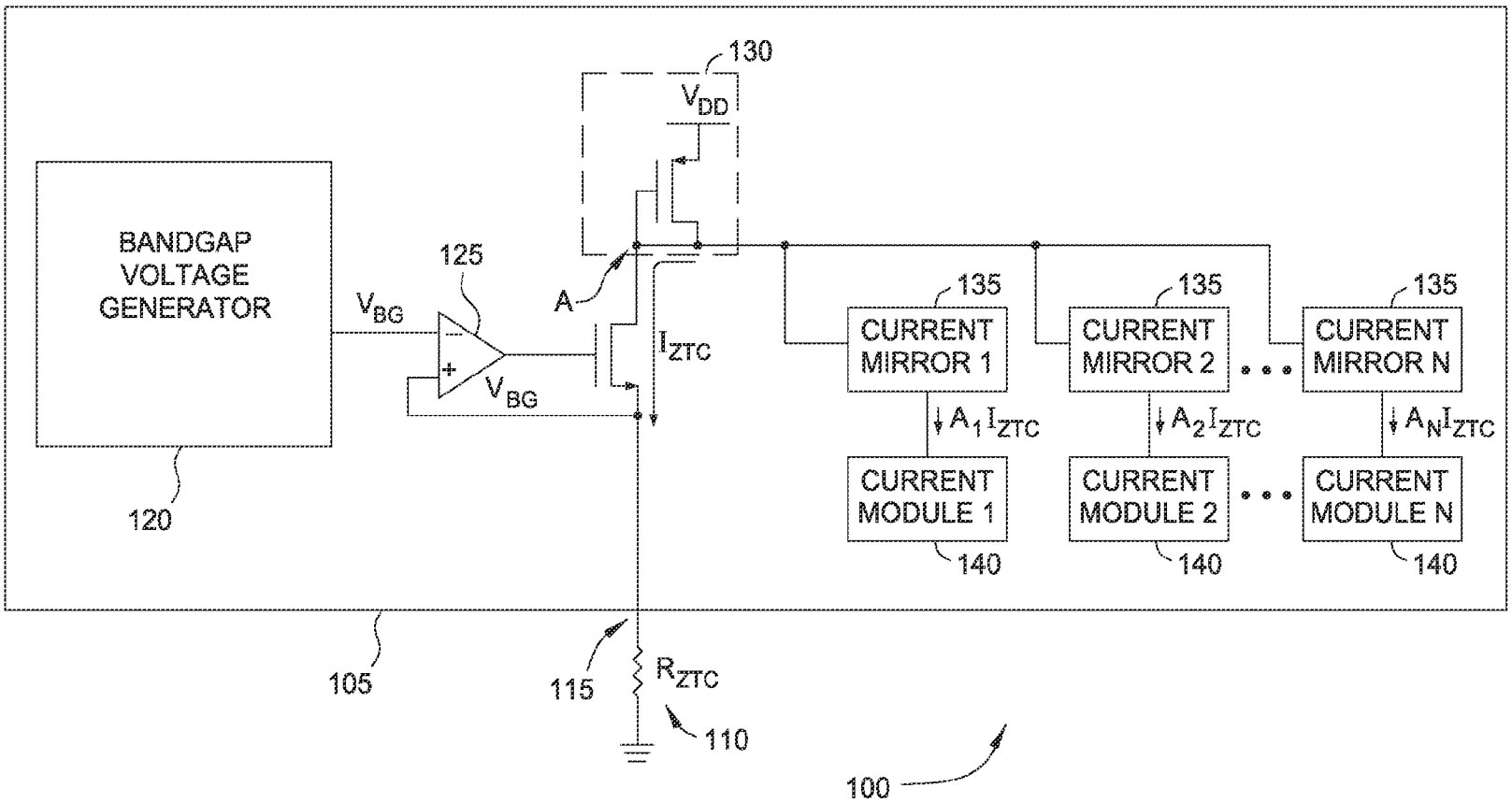
FIG. 1 illustrates a system for generating a ZTC current using a ZTC resistor, according to one embodiment described herein.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Various embodiments of the present technology provide mixed-signal systems and methods for improving usability. Many circuit components in mixed-signal systems require a bias current for performing different applications such as amplification, analog-to-digital conversion, input detection, and the like. In some instances, designers prefer to use a bias current that does not vary with temperatures. For example, if a mixed-signal system is exposed to varying temperatures, the designer may prefer to bias the different circuit modules with a zero-temperature coefficient (ZTC) current which is substantially constant as the temperature of the circuit elements used to generate the ZTC current changes. Thus, as the temperature of the underlying circuit elements changes, the ZTC current, and thus, the bias currents, remain the same.

In one embodiment, a mixed-signal system may include a bandgap voltage generator that produces a temperature-independent voltage (referred to herein as a bandgap voltage) which is then used to produce a current across a resistor. If the material of the resistor is selected such that its resistivity does not change relative to temperature (i.e., a ZTC resistor), then current flowing through the resistor also does not vary with temperature—i.e., the current is a ZTC current. However, fabricating ZTC resistors into semiconductor integrated circuits (ICs) is either difficult or expensive. Accordingly, to bias circuit elements in an IC with a ZTC current produced from an external ZTC resistor, the IC must include a pin that couples to the ZTC resistor. This structure increases costs and requires more space than a design which is able to generate a ZTC current using circuit elements that are integrated into an IC.

Instead of using a ZTC resistor, a ZTC current may be generated by using resistors integrated into an IC even if these resistors vary with temperature. Specifically, instead of applying the temperature-independent bandgap voltage to a ZTC resistor, the bandgap voltage may be applied to a temperature-dependent resistor to generate a first current that varies (either proportionally or complementary) with temperature. Additionally, the mixed-signal system may generate a second current for compensating for the temperature variance of the first current. If the two currents change in the same manner relative to temperature (i.e., the respective slopes or rates of change of the currents are the same when the underlying circuit elements are exposed to the same temperature variations), the difference between the currents remains constant. Thus, if the currents are subtracted, regardless of the temperature change, the resulting current is a constant value. Taking advantage of this relationship, a mixed-signal system, for example, may subtract the first and second currents to yield a ZTC current. This current may then be used to bias the various components in an IC without requiring an additional pin or an external resistor.

FIG. 1 illustrates a system 100 for generating a ZTC current using a ZTC resistor, according to one embodiment described herein. As shown, the system 100 includes an IC 105 coupled to an external ZTC resistor 110. The IC 105 may include a pin 115 that is electrically coupled to the ZTC resistor 110. In one embodiment, both the ZTC resistor 110 and the IC 105 may be mounted on, for example, a printed circuit board.

ZTC resistor 110 may be any resistor whose resistivity does not vary as the temperature of the material of the resistor 110 changes—i.e., resistor 110 has a temperature coefficient near zero. In one embodiment, the material or structure of the ZTC resistor 110 may be such that the ZTC resistor 110 cannot be incorporated into the IC 105 thereby requiring resistor 110 to be located externally to IC 105. However, this may increase the cost and complexity of the system 100 relative to a system that generates a ZTC current without using an external resistor.

IC 105 includes a bandgap voltage generator 120, a buffer 125, a ZTC current generator 130, current mirrors 135, and circuit modules 140. Specifically, the bandgap voltage generator 120 may be any circuit that generates a voltage that does not vary with temperature. Historically, the output of the bandgap voltage generator 120 is related to the bandgap of silicon (1.22 eV). Although the output of the generator 120 is referred to herein as a bandgap voltage ($V_{BG}$), the value of bandgap voltage is not limited to the bandgap of silicon. In one embodiment, $V_{BG}$ may be greater than 1 V (e.g., from 1.15 to 1.3 V) while in other embodiments $V_{BG}$ may be less than 1 V. Regardless of the value of the bandgap voltage, bandgap voltage generator 120 may be configured such that bandgap voltage's value does not vary as the temperature of the components in the generator 120 changes.

As shown, the bandgap voltage is applied to the inverting terminal of the buffer 125 which copies the voltage from its inverting terminal to the non-inverting terminal, thereby applying $V_{BG}$ on one end of the ZTC resistor 110. Because the other end of the ZTC resistor 110 may be coupled to a reference voltage (e.g., ground), the bandgap voltage causes the ZTC current generator 130 to source a current equal to $V_{BG}/R_{ZTC}$. Assuming that both $V_{BG}$ and $R_{ZTC}$ 110 do not vary with temperature, ZTC current generator 130 sources a ZTC current ($I_{ZTC}$).

Figure 3:
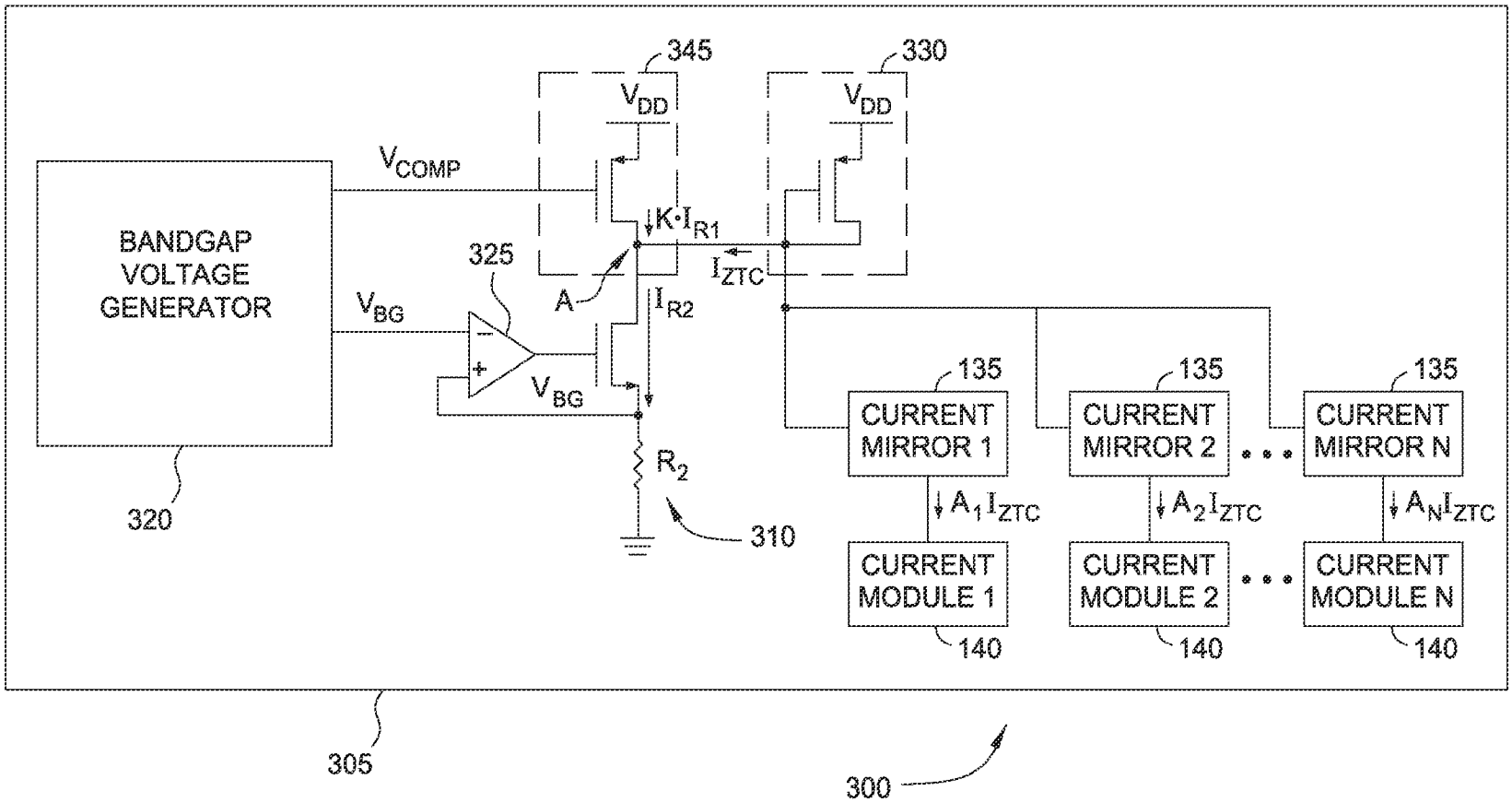
FIG. 3 illustrates a system for generating the ZTC current using a resistor whose resistance varies with temperature, according to one embodiment described herein.

ZTC current generator 130 may also be coupled to one or more current mirrors 135 for reproducing the ZTC current throughout the IC 105. Each current mirror 135 may add a gain ($A_1, A_2 \ldots A_N$) when mirroring the ZTC current. In this manner, the ZTC current may be mirrored as many times as needed to provide temperature-independent bias currents. Although FIG. 3 illustrates only three current mirrors 135, IC 105 may include hundreds if not thousands of current mirrors 135. The bias currents (i.e., the ZTC current modified by the gain associated with a particular current mirror 135) are transmitted to respective circuit modules 140 which may be used to amplify analog signals, perform analog-to-digital conversion, detect input, and the like. Specifically, circuit modules 140 may be, for example, driver circuits that transmit a modulated signal for performing capacitive sensing that detects user interaction with an input device. Or the circuit modules 140 may be source drivers that update a display in an input device. In this manner, system 100 generates a plurality of bias currents that do not vary with temperature.

Figure 2A:
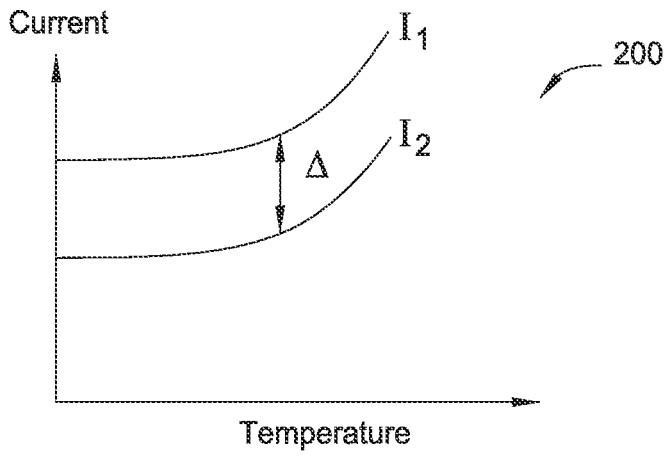
FIGS. 2A-2B are graphs illustrating subtracting two temperature-dependent currents, according to embodiments described herein.
Figure 2B:
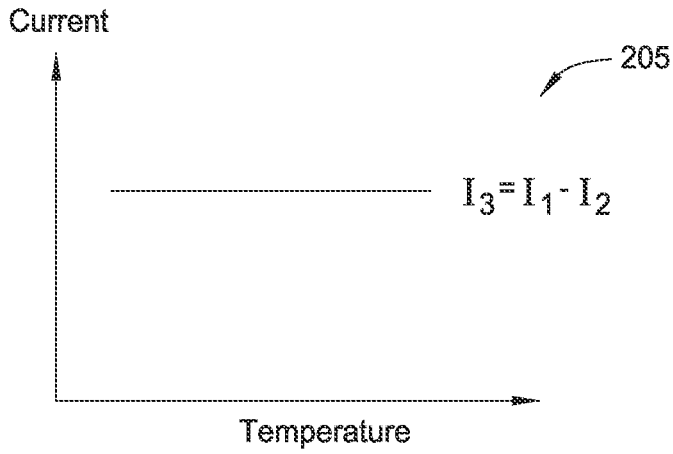

FIGS. 2A-2B are graphs illustrating subtracting two temperature-dependent currents to yield a ZTC current, according to embodiments described herein. As shown, graph 200 in FIG. 2A illustrates two currents that vary proportionally with temperature—i.e., as temperature increases, the current increases. As used herein, a voltage or current that increases proportional to an increase in temperature is referred to as "proportional to absolute temperature" (PTAT) while a voltage or current that decreases in response to an increase in temperature is referred to as "complementary to absolute temperature" (CTAT). Graph 200 illustrates two PTAT currents which have absolute values that differ by a constant value (Δ). Stated differently, the slopes of the currents $I_1$ and $I_2$ change at the same rate such that the change in current resulting from varying the temperature in the circuit elements used to generate currents $I_1$ and $I_2$ is the same for each current.

Chart 205 of FIG. 2B illustrates the current resulting from subtracting the two currents shown in chart 200. Because the difference Δ between currents $I_1$ and $I_2$ does not change with temperature, subtracting these currents yields a ZTC current $I_3$. Thus, graph 205 illustrates that two currents which vary with temperature may be subtracted to yield a current that does not vary with temperature. As will be discussed below, the underlying circuit may be designed to set the difference Δ between currents $I_1$ and $I_2$, and thus, the ZTC current $I_3$ to any desired value. Moreover, although FIGS. 2A-2B illustrate PTAT currents, the same analysis applies to CTAT currents where the difference Δ between the currents remains constant as the temperature of the underlying circuit elements changes. Although currents $I_1$ and $I_2$ are non-linear, other circuit components may be used to generate linear currents. Nonetheless, the embodiments described herein may be used to ensure that the difference between these linear currents remains constant, and thus, subtracting these currents yields a ZTC current.

FIG. 3 illustrates a system 300 for generating a ZTC current using a resistor 310 whose resistance varies with temperature, according to embodiments described herein. As shown, system 300 includes an IC 305 that includes an internal resistor ($R_2$) 310 for generating the ZTC current $I_{ZTC}$ in contrast to system 100 of FIG. 3 which relies on an external ZTC resistor for generating a ZTC current. That is, internal resistor 310 is integrated into IC 305. In one embodiment, internal resistor 310 is made from materials that are compatible with IC fabrication techniques. Specifically, internal resistor 310 may include a material compatible with silicon-based fabrication techniques. For example, internal resistor 310 may be made of polysilicon or other suitable material that is deposited onto the IC 310 in one or more IC fabrication steps. However, the resistivity of such a material may vary with temperature, and thus, even if the voltage $V_{BG}$ across resistor 310 remains unchanged, the current through the resistor 310 changes as the temperature of the resistor 310 varies.

IC 305 includes a bandgap voltage generator 320 which produces a bandgap voltage $V_{BG}$ that does not vary with temperature. Using a buffer 325, IC 305 reproduces $V_{BG}$ at one end of resistor 310. Although the voltage across resistor 310 does not change with varying temperature, the resistivity of resistor 310 does; accordingly, the current $I_{R2}$ changes proportionally to the changing resistivity of resistor 310.

In addition to providing the bandgap voltage, the bandgap voltage generator 320 may provide a compensation voltage ($V_{COMP}$). In one embodiment, the compensation voltage is an internal voltage used by the generator 320 when generating the bandgap voltage. In one embodiment, unlike the bandgap voltage, the compensation voltage does vary with temperature. IC 305 uses the compensation voltage as a control parameter for controlling a compensation current generator 345 (i.e., the compensation voltage is applied to the gate of the transistor). Based on the control parameter, the compensation current generator 345 may generate the compensation current ($K*I_{R1}$) where K is a scaling factor or gain of the transistor in the compensation current generator 345.

At node A, the compensation current and the current flowing through the resistor 110 are subtracted to yield the ZTC current $I_{ZTC}$. As shown by FIGS. 2A and 2B, so long as the two currents at node A change at the same rate as the temperature varies, subtracting the currents results in a current that does not change with temperature. Accordingly, since IC 305 is designed such that compensation current $I_{R1}$ and current $I_{R2}$ change at the same rate respective to temperature fluctuations, subtracting the currents at Node A causes the ZTC current generator 330 to source the ZTC current $I_{ZTC}$. Like in FIG. 3, the ZTC current may be mirrored by the current mirrors 135 and used as a biasing current for any number of different types of circuit modules 140 in the IC 305.

Although not shown, the biasing currents (or the output of the ZTC current generator 330) may be transmitted to other ICs in system 300 in addition to being used by circuit modules 140 internal to IC 305. Additionally, in other embodiments, the different circuit or modules shown as being included within IC 305 may be included in other ICs. For example, system 300 may include a printed circuit board on which multiple ICs are mounted. The ICs may be interconnected such that the varying voltages and currents shown in system 300 may be shared by the ICs. For example, the bandgap voltage generator 300 may be located on a separate IC which transmits the compensation and bandgap voltages to IC 305.

Figure 4A:
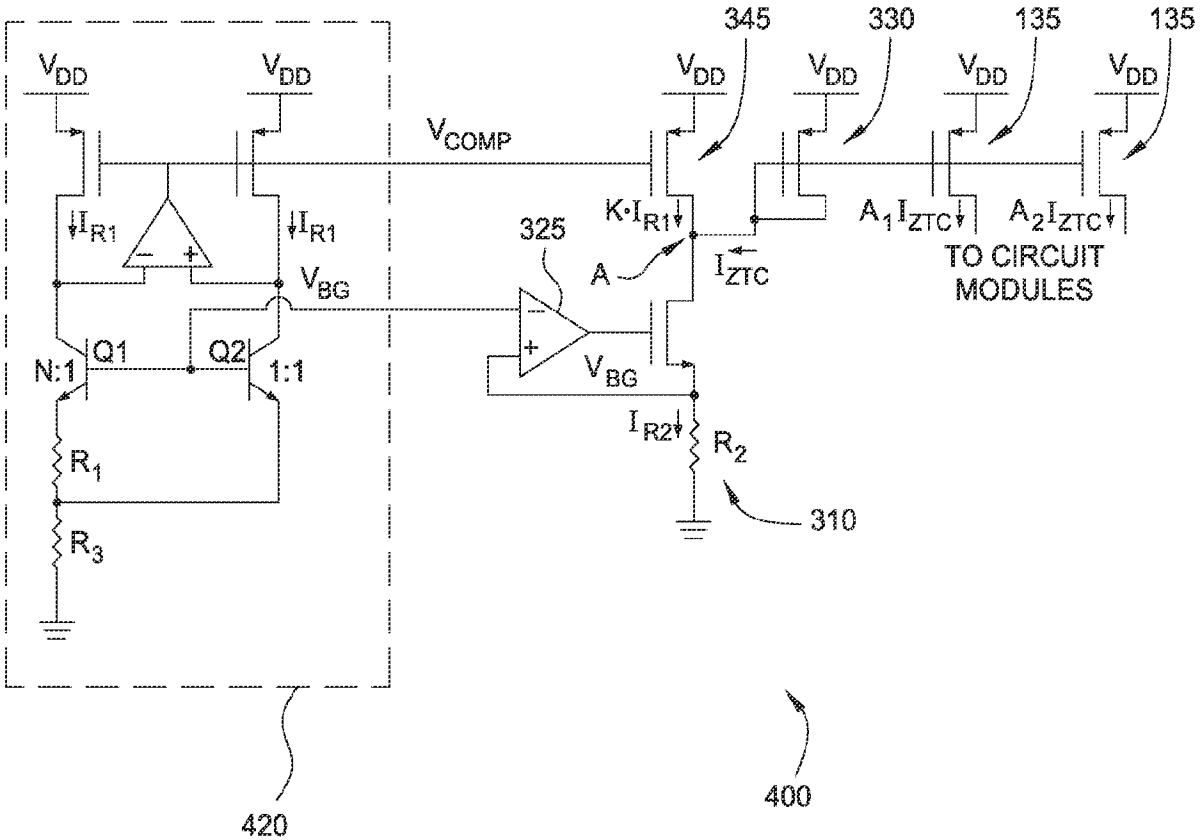
FIGS. 4A-4B illustrate circuits for generating the ZTC current using a resistor whose resistance varies with temperature, according to one embodiment described herein.
Figure 4B:
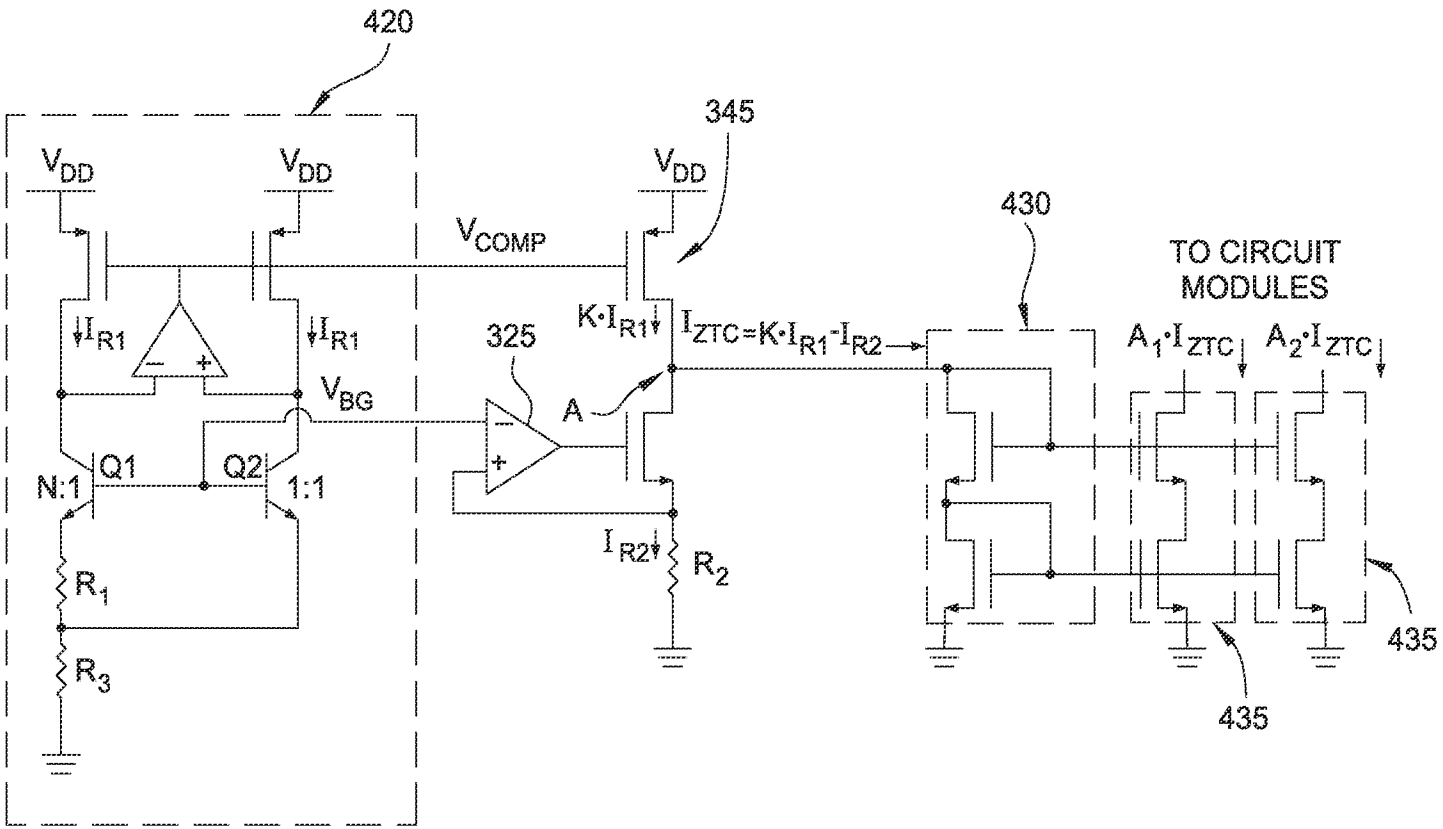

FIG. 4A-4B illustrate circuits for generating a ZTC current using a resistor whose resistance varies with temperature, according to one embodiment described herein. As shown, FIG. 4A illustrates the different circuit elements used for generating the compensation and bandgap voltages. The design of the bandgap voltage generator 420, however, is only for illustrative purposes and does not limit the scope of the present embodiments. Generally, subtracting two current that vary based on temperature to generate a ZTC current may be used with any type of generation circuit so long as these circuits generate currents that change at the same rate relative to temperature. As shown here, bandgap voltage generator 420 outputs a compensation voltage that causes the compensation current generator 345 to generate a compensation current that is scaled relative to a current flowing in generator 420—i.e., $I_{R1}$. Accordingly, in this embodiment, the compensation current generator 345 serves as a current mirror for reproducing a scaled version of a current flowing in the bandgap voltage generator 420. Specifically, the compensation current $K*I_{R1}$ is set, at least in part, by the physical properties of resistor $R_1$ in generator 420. This compensation current may vary with temperature at the same rate as the current $I_{R2}$ flowing through the internal resistor $R_2$ 310.

Based on Kirchhoff's current law, the currents at node A may be expressed as:

$$I_{ZTC}=I_{R2}-K*I_{R1} \tag{1}$$

Using Ohm's law, equation 1 may further be expressed as:

$$I_{ZTC} = \frac{V_{BG}}{R_2} - K * I_{R1} \tag{2}$$

Further, $I_{R1}$ is approximately equal to the difference in base-to-emitter voltages of Q1 and Q2 ($\Delta V_{BE}=V_{BE_Q2}-V_{BE_Q1}$) divided by $R_1$, and thus, equation 2 may be rewritten as:

$$I_{ZTC} = \frac{V_{BG}}{R_2} - K * \frac{\Delta V_{BE}}{R_1} \tag{3}$$

Assuming that the physical design of $R_1$ is already set based on the design of the bandgap voltage generator 420, Equation 3 may be used to identify the value of $R_2$ that leads to a ZTC current. Stated differently, Equation 3 may be used to identify a value of $R_2$ where the slope of $I_{ZTC}$ is zero (i.e., the value of $R_2$ such that $I_{ZTC}$ does not change with respect to temperature). Accordingly, after differentiating Equation 3 with respect to temperature and setting $\partial I_{ZTC}/\partial T$ equal to zero, the equation may be solved for $R_2$ to yield:

$$(R_2)^2 = \frac{V_{BG} * \left(\frac{\partial R_2}{\partial T}\right)}{K * \left(\frac{\Delta V_{BE}}{(R_1)^2} * \frac{\partial R_1}{\partial T} - \frac{\partial \Delta V_{BE}}{\partial T} * \frac{1}{R_1}\right)} \tag{4}$$

Equation 4 shows that $R_2$ is a function of $\partial R_1/\partial T$ and $\partial R_2/\partial T$. If, however, $R_1$ in the bandgap voltage generator 420 is made of the same material as $R_2$, then the following equation relating the change of resistivity according to temperature (i.e., R(T)) will be the same for both resistors $R_1$ and $R_2$ (and assuming the resistors have an approximately linear temperature coefficient):

$$R(T) = \frac{\text{rho}(T_0) * l}{t * w}[1 + \alpha(T - T_0)] \tag{5}$$

In Equation 5, rho($T_0$) is the material resistivity at the reference temperature $T_0$, l is the length of the resistor, t is the thickness of the resistor, w is the width of the resistor, and $\alpha$ is the temperature coefficient of the material. Equation 5 can be further simplified to:

$$R(T) = R(T_0) + M_R(T - T_0) \tag{6}$$

$$\text{where } R(T_0) = \frac{\text{rho}(T_0) * l}{t * w} \text{ and } M_R = R(T_0) * \alpha$$

In Equation 6, $M_R$ (ohm/° C.) defines how the resistivities of the resistors $R_1$ and $R_2$ change relative to temperature. Thus, $M_R$ can be substituted in place of $\partial R_1/\partial T$ and $\partial R_2/\partial T$ in Equation 4. Doing so results in the following:

$$(R_2)^2 = \frac{V_{BG} * M_{R2}}{K * \left(\frac{\Delta V_{BE}}{(R_1)^2} * M_{R1} - \frac{\partial \Delta V_{BE}}{\partial T} * \frac{1}{R_1}\right)} \tag{7}$$

In addition to being made of the same material, if resistor $R_1$ and $R_2$ have the same thickness (t) and width (w), then the resistivity of the resistors may be expressed as a ratio by using equation 5. Because the only difference between the resistors $R_1$ and $R_2$ is the their respective lengths, all of the terms in Equation 5 cancel out, thereby yielding:

$$\frac{R_2(T)}{R_1(T)} = \frac{l_2}{l_1} \tag{8}$$

In many IC manufacturing processes, the designer controls only the length (l) of the various resistive elements in the IC. That is, to change the resistance value of the resistors, the designer increases or decreases the length of the resistor while the thickness and width remain fixed. Notably, Equation 8 illustrates that the ratio of the resistivity of the resistors $R_1$ and $R_2$ is not dependent on temperature, but length. Following a similar process, the ratio of $M_{R1}$ to $M_{R2}$ may be expressed as a ratio:

$$\frac{M_{R2}(T)}{M_{R1}(T)} = \frac{l_2}{l_1} \tag{9}$$

Combining Equation 9 with Equation 8 and solving for $M_{R2}$ yields:

$$M_{R_2}(T) = \frac{M_{R1}(T) * R_2(T)}{R_1(T)} \tag{10}$$

Equation 10 is then substituted in replace of $M_{R2}$ in Equation 7 to yield:

$$R_2 = \frac{V_{BG} * M_{R1}}{K * \left(\frac{\Delta V_{BE} * M_{R1}}{R_1} - \frac{\partial \Delta V_{BE}}{\partial T}\right)} \tag{11}$$

Further, because $\Delta V_{BE}$ is approximately equivalent to $V_t$*ln(N) where $V_t$ is the thermal voltage and N is the ratio of emitter areas between the transistors Q2 and Q1, substituting this approximation of bandgap voltage references into Equation 11 yields:

$$R_2 = \frac{V_{BG} * M_{R1} * R_1}{K * V_t * \ln(N) * \left(M_{R1} - \frac{R_1}{T}\right)} \tag{12}$$

The term $$\left(M_{R1} - \frac{R_1}{T}\right)$$

in the denominator of Equation 12 may be changed by substituting Equation 6 in for $R_1$ which, after simplifying, yields:

$$M_{R1} - \frac{R_1}{T} = \frac{T_0 * M_{R1}}{T} - \frac{R_1(T_0)}{T} \tag{13}$$

Equation 13 may then be used to replace the $$\left(M_{R1} - \frac{R_1}{T}\right)$$

term in Equation 12 to result in:

$$R_2 = \frac{V_{BG} * M_{R1} * R_1}{K * \frac{k}{q} * \ln(N) * (T_0 * M_{R1} - R_1(T_0))} \tag{14}$$

In Equation 14, k is Boltzmann's constant and q is the elementary unit of charge. Accounting for a finite $\beta$ in transistors Q1 and Q2, Equation 14 may be expressed as:

$$R_2 = \frac{(\beta + 1) * V_{BG} * M_{R1} * R_1}{\beta * K * \frac{k}{q} * \ln(N) * (T_0 * M_{R1} - R_1(T_0))} \tag{15}$$

Equation 15 can be reduced to the form where $R_2$ is equal to C*$R_1$ as shown by the following expression:

$$C = \frac{(\beta + 1) * V_{BG} * M_{R1}}{\beta * K * \frac{k}{q} * \ln(N) * (T_0 * M_{R1} - R_1(T_0))} \tag{16}$$

Equation 16 illustrates that C is a constant and independent of process, temperature, and voltage variations. Because C is independent of temperature, the resistance of resistor $R_2$ is a constant multiple of $R_1$, and thus, $R_2$ can be chosen to yield a ZTC current. This relationship is further explained by substituting the relationship $M_{R1}=R_1(T_0)*\alpha$ of Equation 6 into Equation 16 to yield:

$$C = \frac{(\beta+1)*V_{BG}*\alpha}{\beta*K*\frac{k}{q}*\ln(N)*(T_0*\alpha-1)} \tag{17}$$

Equation 17 illustrates that C is a function of parameters that are, to a first-order, constant over process, voltage, and temperature variations. Therefore, once C is chosen, this constant does not have to be tuned or calibrated.

To solve for the ZTC current $I_{ZTC}$, Equation 2 may be manipulated (and accounting for β) to yield:

$$R_2 = \frac{(\beta+1)*V_{BG}*R_1}{(\beta+1)*I_{ZTC}*R_1*+K*V_t*\ln(N)*\beta} \tag{18}$$

Equation 18 has a dependence on β because some BJTs have a low β but we assume here that β is not a strong function of temperature. If β is large then it does not matter if β is a function of temperature. Setting Equation 18 equal to Equation 15 and solving for $I_{ZTC}$ yields:

$$I_{ZTC} = \frac{-K*k*\ln(N)*\beta}{M_{R1}*q*(\beta+1)} \tag{19}$$

Equation 19 illustrates that the ZTC current $I_{ZTC}$ is independent of temperature. That is, none of the parameters shown in Equation 19 that set the value of the ZTC current change as temperature varies.

The value $M_{R1}$ may vary according to the variation of the fabrication processes used to manufacture resistor $R_1$. For example, the actual value of $M_{R1}$ may change slightly as each IC 305 is manufactured because of the variations of the semiconductor fabrication techniques. This variation in $M_{R1}$, however, changes the absolute value of $I_{ZTC}$—i.e., the constant difference Δ between $K*I_{R1}$ and $I_{R2}$—but not the temperature coefficient. The change in absolute value of $I_{ZTC}$ may corrected or adjusted, for example, by adding digital calibration bits to the compensation current generator 345 that scales $I_{R1}$ by K or to a diode connected transistor 330. The calibration bits may then be used to tune $I_{ZTC}$ to the desired value.

Referring to Equation 19, if $M_{R1}$ is negative, the numerator and denominator are both negative, and thus, ZTC current $I_{ZTC}$ is positive. This implies that $V_{BG}/R_2$ and $K*I_{R1}$ are both PTAT. If, however, $M_{R1}$ is positive, then the ZTC current $I_{ZTC}$ is negative. To account for the situation where $M_{R1}$ is positive, the transistor in the compensation current generator 345 would be a NMOS device instead of PMOS device so that the ZTC current $I_{ZTC}$ is positive and sunk by the NMOS device instead of being sourced by the PMOS device as shown in FIG. 4A. Accordingly, the design of IC 305 may be adjusted to function with either PTAT or CTAT currents.

FIG. 4B illustrates a circuit 450 that may be used when $M_{R1}$ is positive. As shown, ZTC current $I_{ZTC}$ is positive and sunk by the NMOS transistor in the ZTC current generator 430. Like in FIG. 4A, the ZTC current may then be reproduced by the current mirrors 435 which provide temperature-independent currents for the different circuit modules on the same chip (or for circuit modules external to the chip). Moreover, although ZT current generator 430 uses two cascaded NMOS transistors, the present disclosure is not limited to such and may use any circuit design for generator 430 that sinks the ZTC current.

Figure 5:
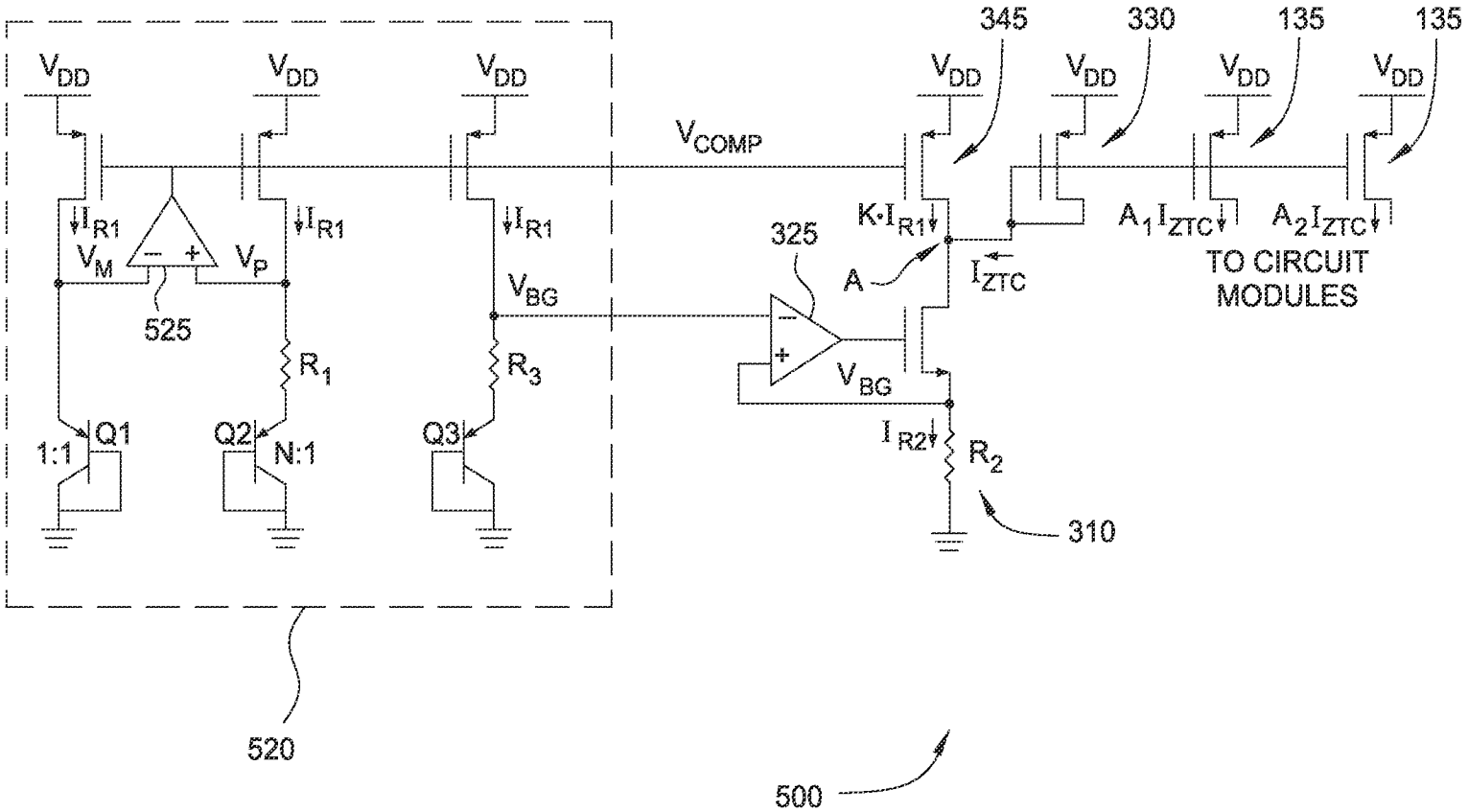
FIG. 5 illustrates a circuit for generating the ZTC current using a resistor whose resistance varies with temperature, according to one embodiment described herein.

FIG. 5 illustrates a circuit 500 for generating a ZTC current using a resistor 310 whose resistance varies with temperature, according to one embodiment described herein. Circuit 500 contains many of the same circuit elements as circuit 400 in FIG. 4A, however, circuit 500 includes a bandgap voltage generator 520 with a different design. Even though the particular circuit design of generator 520 is different than the design of generator 420 in FIG. 4A, generator 520 also provides a bandgap voltage $V_{BG}$ that does not vary with temperature. Like in FIG. 4A, the output of buffer 525 (i.e., $V_{COMP}$) in the bandgap voltage generator 520 may be used as the control parameter for the compensation current generator 345 to generate the compensation current $K*I_{R1}$. Thus, FIGS. 6 and 7 illustrate that the techniques discussed herein are not limited to any particular bandgap voltage generator design.

Figure 6:
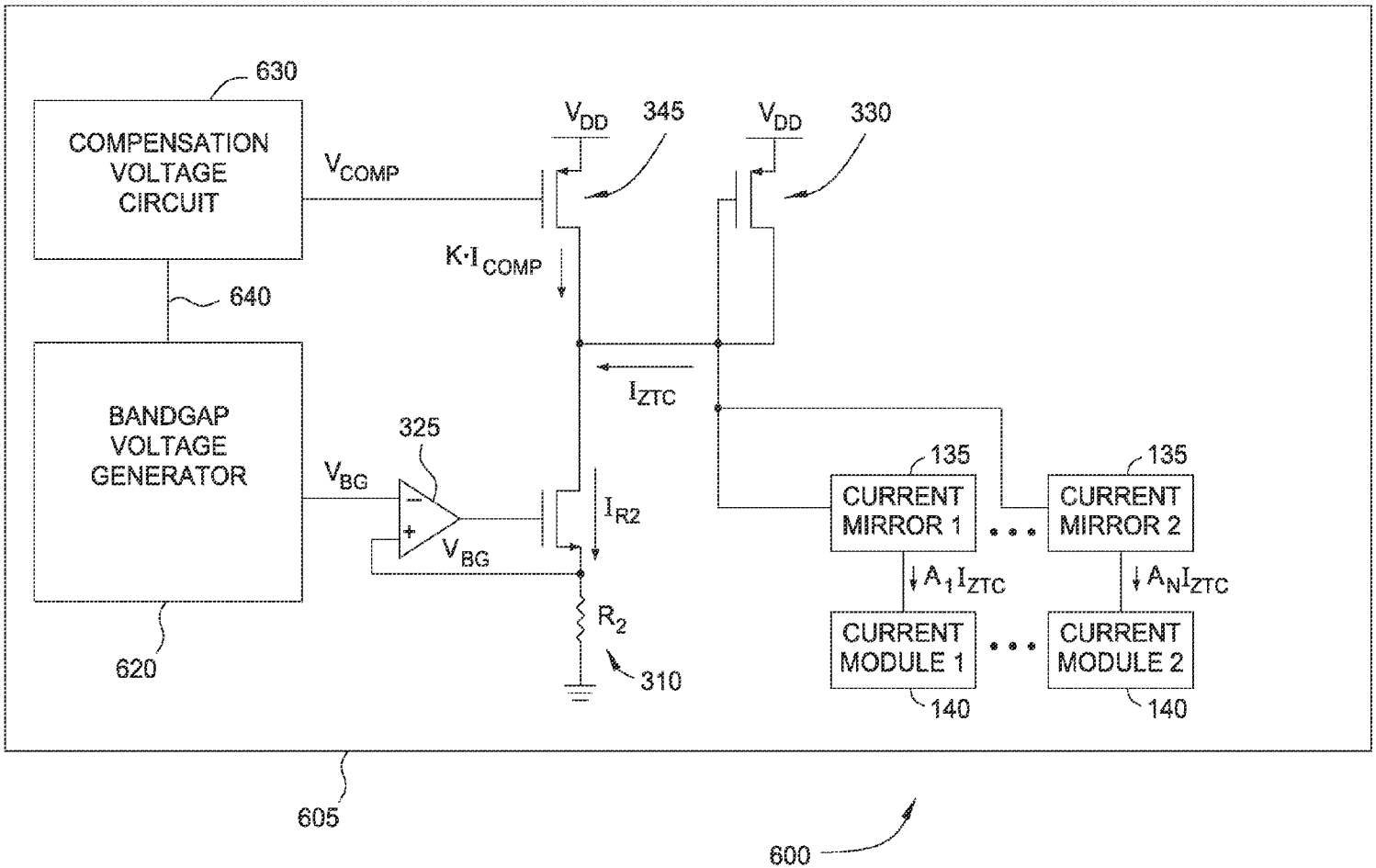
FIG. 6 illustrates a system for generating the ZTC current using a temperature-varying resistance and a compensation voltage circuit, according to one embodiment described herein.
Figure 7:
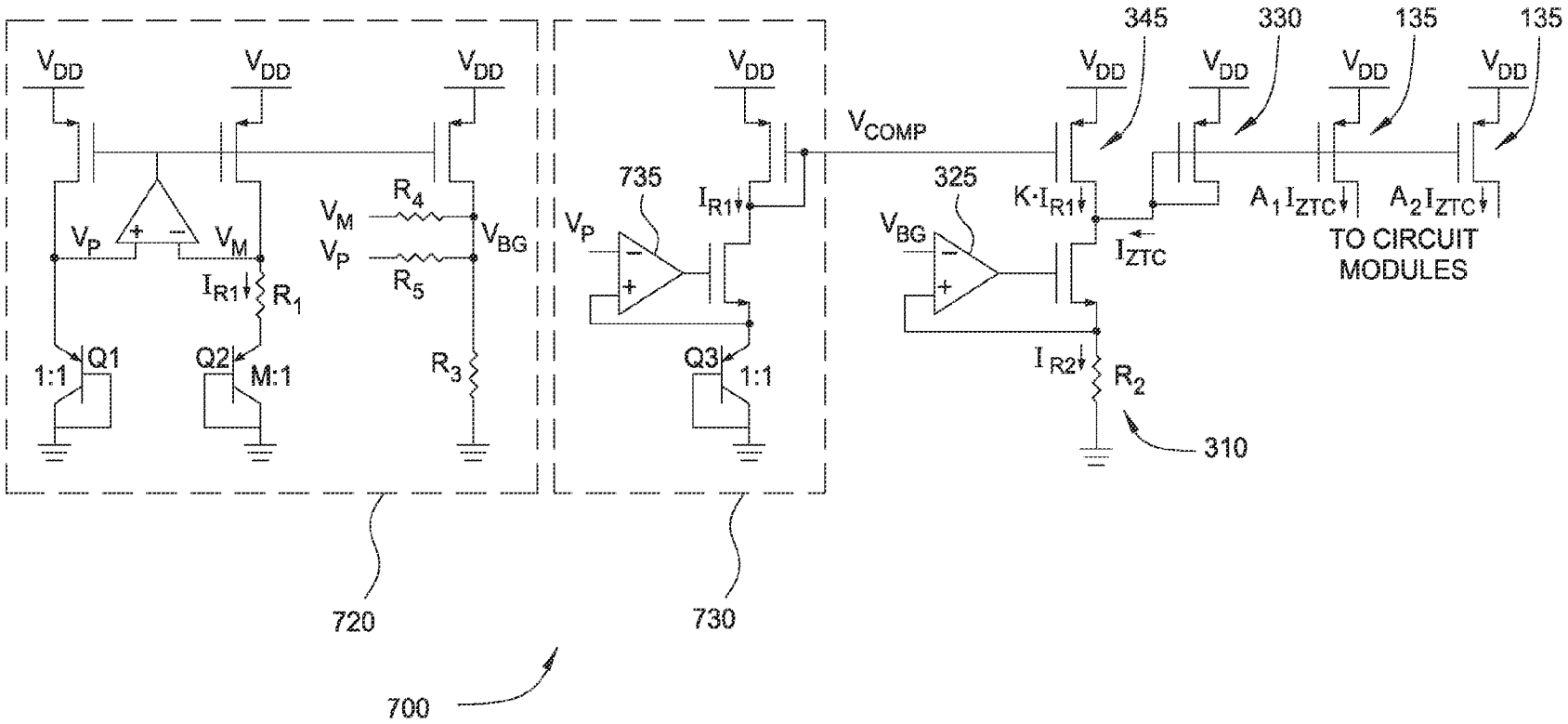
FIG. 7 illustrates a circuit for generating the ZTC current using a temperature-varying resistance and the compensation voltage circuit, according to one embodiment described herein.

FIG. 6 illustrates a system 600 for generating a ZTC current using a temperature-varying resistance and a compensation voltage circuit, according to embodiments described herein. As shown, system 600 includes an IC 605 which includes buffer 325, compensation current generator 345, ZTC current generator 330, resistor 310, current mirrors 135, and circuit modules 140 whose functions and characteristics have been discussed previously. In addition, IC 605 includes a compensation voltage circuit 630 that generates the compensation voltage $V_{COMP}$. As shown here, the compensation voltage circuit 630 is distinct from the bandgap voltage generator 620. Stated differently, some bandgap voltage generation designs do not directly provide a suitable control parameter that may be used to generate the compensation current. Instead, to generate a compensation current that can be subtracted from $I_{R2}$ to yield the ZTC current $I_{ZTC}$, system 600 includes the compensation voltage circuit 630 which may be designed to provide the compensation voltage $V_{COMP}$ to the compensation current generator 345.

Although the compensation voltage circuit 630 is distinct from the bandgap voltage generator 620, circuit 630 may nonetheless use a different control parameter (transmitted on path 640) from the bandgap voltage generator 620 to generate the compensation voltage $V_{COMP}$. That is, even though the bandgap voltage generator 620 does not produce the compensation voltage directly, other control parameters in the generator 620 may be used by the compensation voltage circuit 630 to generate the compensation voltage. In other embodiments, however, the compensation voltage circuit 630 may generate the compensation voltage without receiving any control parameter from the bandgap voltage generator 620—i.e., the conductive path 640 is not needed. Thus, even if the bandgap voltage generator 620 does not directly provide a suitable control parameter for generating the compensation current, the compensation current may still be generated by the compensation voltage circuit 630.

Although not shown, the various circuits and modules shown in FIG. 6 may be located external to IC 605. For example, system 600 may include a second IC that contains the compensation voltage circuit 630. The two ICs may be mounted on the same printed circuit board and the second IC may be communicatively coupled to IC 605 such that the compensation voltage is provided to IC 605. In this manner, the different circuit and modules in IC 605 may be distributed onto a plurality of different devices.

FIG. 7 illustrates a circuit 700 for generating a ZTC current using a temperature-varying resistance and a compensation voltage circuit 630, according to embodiments described herein. Specifically, circuit 700 includes bandgap generator 720 and a separate compensation voltage circuit 730. In one embodiment, the different modules and circuit elements shown in circuit 700 may be located on a single IC. However, in other embodiments, the different elements may be distributed onto various interconnected devices.

In circuit 700, the bandgap voltage generator 720 does not directly provide the compensation voltage for generating the compensation current. Instead, one of the voltages generated by the bandgap voltage generator 720 (i.e., voltage $V_P$) is introduced at the buffer 735 of the compensation voltage generator 730 as a control parameter. The compensation voltage generator 730 then derives the compensation voltage using this voltage (e.g., voltage $V_P$). In turn, generator 730 then provides the compensation voltage to the compensation current generator 345.

Like in FIGS. 3-5, buffer 325 in FIG. 7 receives the bandgap voltage from the bandgap voltage generator 720. That is, $V_{BG}$ is routed to the inverting input of buffer 325 (the connection between generator 720 and buffer 325 is omitted for clarity) which drives this voltage across resistor $R_2$. Thus, the bandgap voltage generator 720 directly controls the bandgap voltage but only indirectly controls the compensation voltage.

Figure 8:
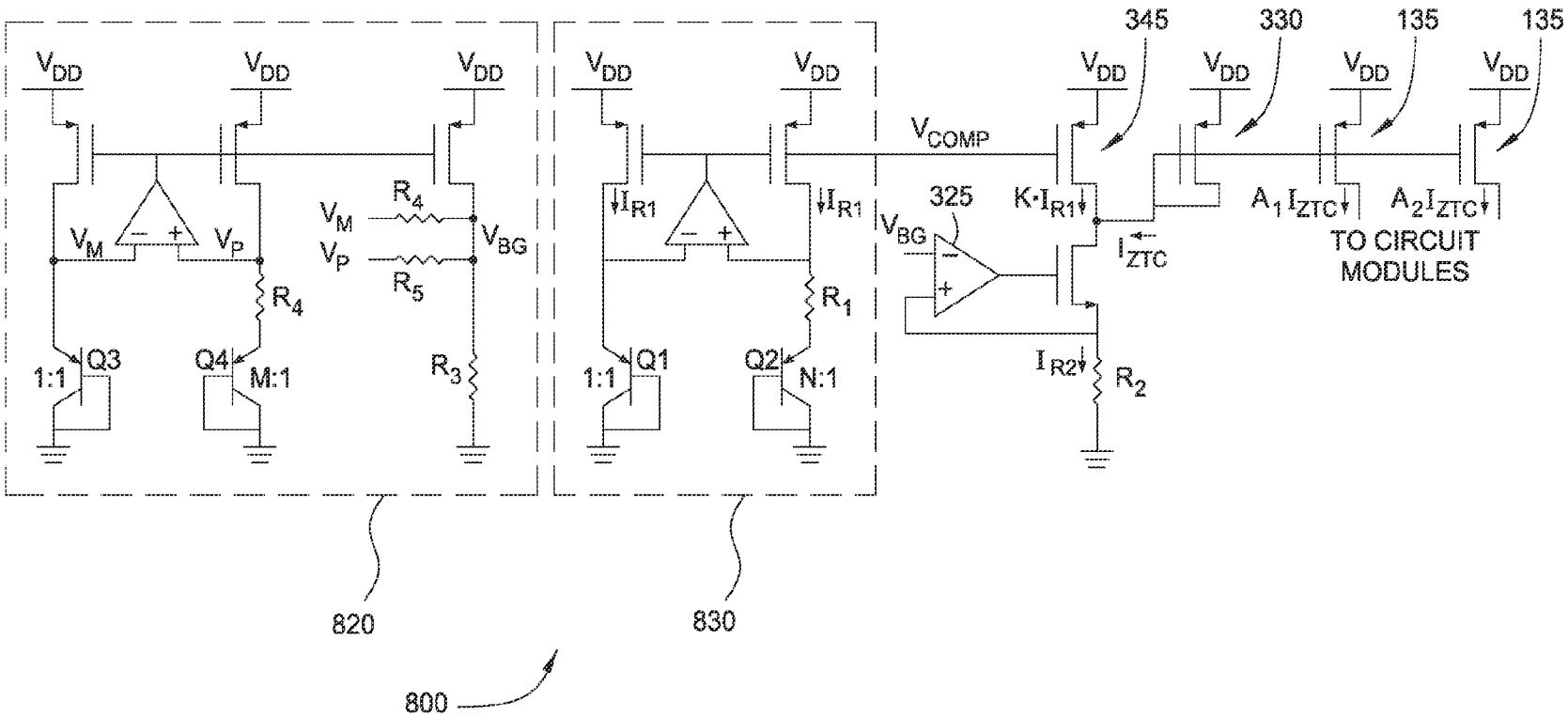
FIG. 8 illustrates a circuit for generating the ZTC current using a temperature-varying resistance and the compensation voltage circuit, according to one embodiment described herein.

FIG. 8 illustrates a circuit 800 for generating a ZTC current using a temperature-varying resistance and a compensation voltage circuit 830, according to embodiments described herein. Circuit 800 includes a bandgap voltage generator 820 and a separate compensation voltage circuit 820. In one embodiment, the different modules and circuit elements shown in circuit 800 may be located on a single IC. However, in other embodiments, the different elements may be distributed onto various interconnected devices.

Like in circuit 700, the bandgap voltage generator 820 in circuit 800 directly controls the bandgap voltage. That is, the bandgap voltage $V_{BG}$ generated by generator 820 is provided to buffer 325 which generates the current $I_{R2}$. In contrast to circuit 700, however, the bandgap voltage generator 820 does not indirectly (or directly) control the compensation voltage. Instead, the compensation voltage circuit 830, independent of the bandgap voltage generator 820, controls the value of the compensation voltage $V_{COMP}$. Accordingly, the compensation voltage, and thus, the compensation current, may be generated without receiving any control parameter from the bandgap voltage generator 820. Thus, separate, independent circuit modules may be used to generate two currents ($I_{R1}$ and $I_{R2}$) that, when subtracted, result in the ZTC current $I_{ZTC}$.

Moreover, the techniques discussed herein may be used with bandgap voltage generators that produce bandgap voltages that are either above 1V or below 1V. For example, the bandgap voltage generators in FIGS. 4 and 5 may generate bandgap voltages greater or equal to 1V while the bandgap voltage generators shown in FIGS. 7 and 8 may generator bandgap voltage less than or equal to 1V.

Figure 9:
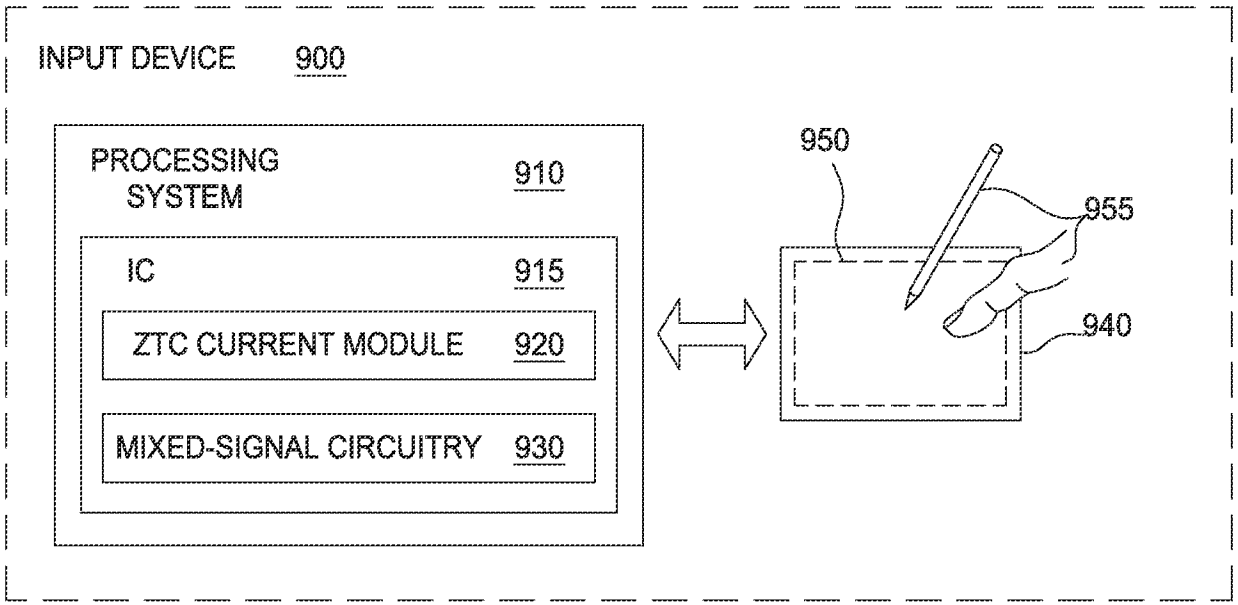
FIG. 9 illustrates an input device with an integrated capacitive sensing device, according to one embodiment described herein.

FIG. 9 illustrates an input device 900 with an integrated capacitive sensing device 940, according to one embodiment described herein. As shown, the input device 900 includes a processing system 910 in communication with the integrated capacitive sensing device 940. Processing system 910 may include one or more ICs 915 that generate, for example, the control signals for at least one of updating a display screen and performing capacitive sensing.

For example in one embodiment, the one or more ICs 915 may be configured to control a mutual capacitance sensor device, and may thus comprise transmitter circuitry configured to transmit signals with transmitter sensor electrodes, and/or receiver circuitry configured to receive signals with receiver sensor electrodes. In another embodiment, the one or more ICs 915 may be configured to control a transcapacitance sensor device, and may thus a comprise circuitry configured for detecting the capacitive coupling between one or more transmitter sensor electrodes (also "transmitter electrodes") and one or more receiver sensor electrodes (also "receiver electrodes"). The one or more ICs 915 configured as a transcapacitance sensor device may be configured to modulated transmitter sensor electrodes relative to a reference voltage (e.g., system ground) to transmit transmitter signals while the receiver sensor electrodes are held substantially constant relative to the reference voltage to facilitate receipt of resulting signals. The one or more ICs 915 may be configured receive and analyze the resulting signal that may comprise effect(s) corresponding to one or more transmitter signals, and/or to one or more sources of environmental interference (e.g. other electromagnetic signals).

Furthermore, IC 915 may include mixed-signal circuitry 930 such as amplifiers, analog-to-digital convertors, user input detection modules and other circuit elements that may use a bias current. Accordingly, IC 915 includes a ZTC current module 920 for generating a ZTC current for biasing these circuit elements. In one embodiment, the ZTC current module 920 may use an internal resistor (i.e., the ZTC current module 920 is not coupled to an external ZTC resistor) for generating the ZTC current by subtracting temperature-dependent currents as shown in FIGS. 3-8.

Input device 900 is shown as a proximity sensor device (also often referred to as a "touchpad" or a "touch sensor device") configured to sense input provided by one or more input objects 955 in a sensing region 950 of the capacitive sensing device 940. Example input objects include fingers and styli, as shown in FIG. 9.

Although embodiments of the present disclosure may be utilized in an input device 100 including a display device integrated with a sensing device, it is contemplated that the invention may be embodied in display devices without integrated sensing devices. The input device 900 may be configured to provide input to an electronic system (not shown). As used in this document, the term "electronic system" (or "electronic device") broadly refers to any system capable of electronically processing information. Some non-limiting examples of electronic systems include personal computers of all sizes and shapes, such as desktop computers, laptop computers, netbook computers, tablets, web browsers, e-book readers, and personal digital assistants (PDAs).

CONCLUSION

Instead of using a ZTC resistor when generating a ZTC current for a mixed-signal system, a temperature independent current $I_{ZTC}$ is generated by using resistors that may be integrated into an IC, even if these resistors vary with temperature. Specifically, instead of applying the bandgap voltage to a ZTC resistor, the bandgap voltage may be applied to a temperature-dependent resistor to generate a first current that varies (either proportionally or complementary) with temperature. Additionally, the mixed-signal system may generate a second current for compensating for the temperature variance of the first current. For example, if the two currents change in the same manner relative to temperature (i.e., the respective slopes of the currents are the same when the underlying circuit elements are exposed to the same temperature variations), the difference between the currents remains constant. Thus, if the currents are subtracted, regardless of the current temperature, the resulting current is a constant value. Taking advantage of this relationship, the mixed-signal system may subtract the first and second currents to yield a ZTC current. This current may then be used to bias the various components in an IC without requiring an additional pin or an external resistor.

Thus, the embodiments and examples set forth herein were presented in order to best explain the embodiments in accordance with the present technology and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed.

In view of the foregoing, the scope of the present disclosure is determined by the claims that follow.

We claim:

1. A method for generating a zero-temperature coefficient (ZTC) current, the method comprising:

generating a first temperature dependent current by applying a temperature independent voltage generated by a bandgap voltage generator to a first resistor, wherein the first resistor is included within an integrated circuit;

generating a control parameter using the bandgap voltage generator;

generating, based on the control parameter, a second temperature dependent current, wherein the first and second temperature dependent currents change at a rate that is substantially the same in response to temperature changes in the integrated circuit; and generating the ZTC current by subtracting the first and second temperature dependent currents.

2. The method of claim 1, wherein a difference between the first temperature dependent current and the second temperature dependent current remains substantially constant as a temperature of one or more respective circuit elements used to generate the first and second temperature dependent currents varies.

3. The method of claim 1, wherein a value of the control parameter, at least in part, is set based on a second resistor, the first and second resistors comprising a same material, wherein a resistivity of the same material varies relative to a temperature of the same material.

4. The method of claim 3, wherein both the first and second resistors are included within the integrated circuit.

5. A circuit that generates a zero-temperature coefficient (ZTC) current, the circuit comprising:

a bandgap voltage generator configured to generate a temperature independent voltage and a control parameter;

a first resistor included within an integrated circuit;

a buffer configured to apply the temperature independent voltage to the first resistor to generate a first temperature dependent current; and a compensation current generator configured to generate, based on the control parameter, a second temperature dependent current, wherein the first and second temperature dependent currents change at a rate that is substantially the same in response to temperature changes in the integrated circuit, wherein the circuit is configured to generate the ZTC current by subtracting the first and second temperature dependent currents.

6. The circuit of claim 5, wherein a difference between the first temperature dependent current and the second temperature dependent current remains substantially constant as a temperature of one or more respective circuit elements used to generate the first and second temperature dependent currents varies.

7. The circuit of claim 5, further comprising a second resistor used, at least in part, to generate the control parameter, the first and second resistors comprising a same material, wherein a resistivity of the same material varies relative to a temperature of the same material.

8. The circuit of claim 5, further comprising a ZTC current generator, wherein an output of the ZTC current generator, an output of the compensation current generator, and one end of the first resistor are electrically coupled to a common node in the circuit such that the first temperature dependent current, the second temperature dependent current, and the ZTC current flow into or out of the node.

9. An integrated circuit that generates a zero-temperature coefficient (ZTC) current, the integrated circuit comprising:

a bandgap voltage generator configured to generate a temperature independent voltage and a control parameter;

a first resistor;

a buffer configured to apply the temperature independent voltage to the first resistor to generate a first temperature dependent current; and a compensation current generator configured to generate, based on the control parameter, a second temperature dependent current, wherein the first and second temperature dependent currents change at a rate that is substantially the same in response to temperature changes in the integrated circuit, wherein the integrated circuit is configured to generate the ZTC current by subtracting the first and second temperature dependent currents.

10. The integrated circuit of claim 9, wherein a difference between the first temperature dependent current and the second temperature dependent current remains substantially constant as a temperature of one or more respective circuit elements used to generate the first and second temperature dependent currents varies.

11. The integrated circuit of claim 9, further comprising a second resistor used, at least in part, to generate the control parameter, the first and second resistors comprising a same material, wherein a resistivity of the same material varies relative to a temperature of the same material.

12. The integrated circuit of claim 9, further comprising a ZTC current generator, wherein an output of the ZTC current generator, an output of the compensation current generator, and one end of the first resistor are electrically coupled to a common node in the circuit such that the first temperature dependent current, the second temperature dependent current, and the ZTC current flow into or out of the node.

* * * * *